United States Patent [19]

Testone

[11] Patent Number: 4,850,188

[45] Date of Patent: Jul. 25, 1989

[54] IONIZED GAS ENERGY CELL

[75] Inventor: Anthony Q. Testone, West Stockbridge, Mass.

[73] Assignee: Testone Enterprises, Inc., Lee, Mass.

[21] Appl. No.: 600,015

[22] Filed: Apr. 13, 1984

Related U.S. Application Data

[63] Continuation of Ser. No. 282,401, Jul. 10, 1981, abandoned.

[51] Int. Cl.[4] ..... F03H 1/00; H05H 1/00

[52] U.S. Cl. ..... 60/202; 313/230; 313/359.1

[58] Field of Search ..... 60/202, 203.1; 123/536, 123/537, 538, 539; 219/383, 121 PM, 121 PR, 121 PP; 239/690, 704, 706, 708, 133, 135, 136; 313/230, 359.1

[56] References Cited

U.S. PATENT DOCUMENTS

| | | | |
|---|---|---|---|
| 2,992,177 | 7/1961 | Morrisson | 60/202 X |
| 3,041,824 | 7/1962 | Berhman | 60/203.1 |
| 3,239,130 | 3/1966 | Naundorf, Jr. | 60/202 |
| 3,308,623 | 3/1967 | Ferrie et al. | 60/203.1 |
| 3,461,190 | 8/1969 | Kemeny et al. | 219/383 X |
| 3,562,486 | 2/1971 | Hatch | 219/121 PR |
| 3,841,824 | 10/1974 | Bethel | 123/536 X |
| 3,854,032 | 12/1974 | Cooper | 219/383 |

*Primary Examiner*—Donald E. Stout
*Attorney, Agent, or Firm*—Irvin A. Lavine

[57] ABSTRACT

Apparatus for generating a stream of high temperature gaseous material comprises a pressure container having an inlet for air under pressure and a restricted outlet orifice. An electrode is within the container, insulated from it, and connected to a source of direct current; it has a discharge point adjacent and aligned with the outlet orifice. The wall of the orifice is conductive and connected to ground. The space between the electrode and the container may converge towards the outlet. A method in which air is compressed within a container having a restricted orifice, at least the portion of the air within the container which is adjacent the orifice is ionized, the excited electrons and ions discharging rapidly from the container through the orifice water or fuel may be introduced into the discharging material, for generation of steam or for combustion, respectively.

1 Claim, 4 Drawing Sheets

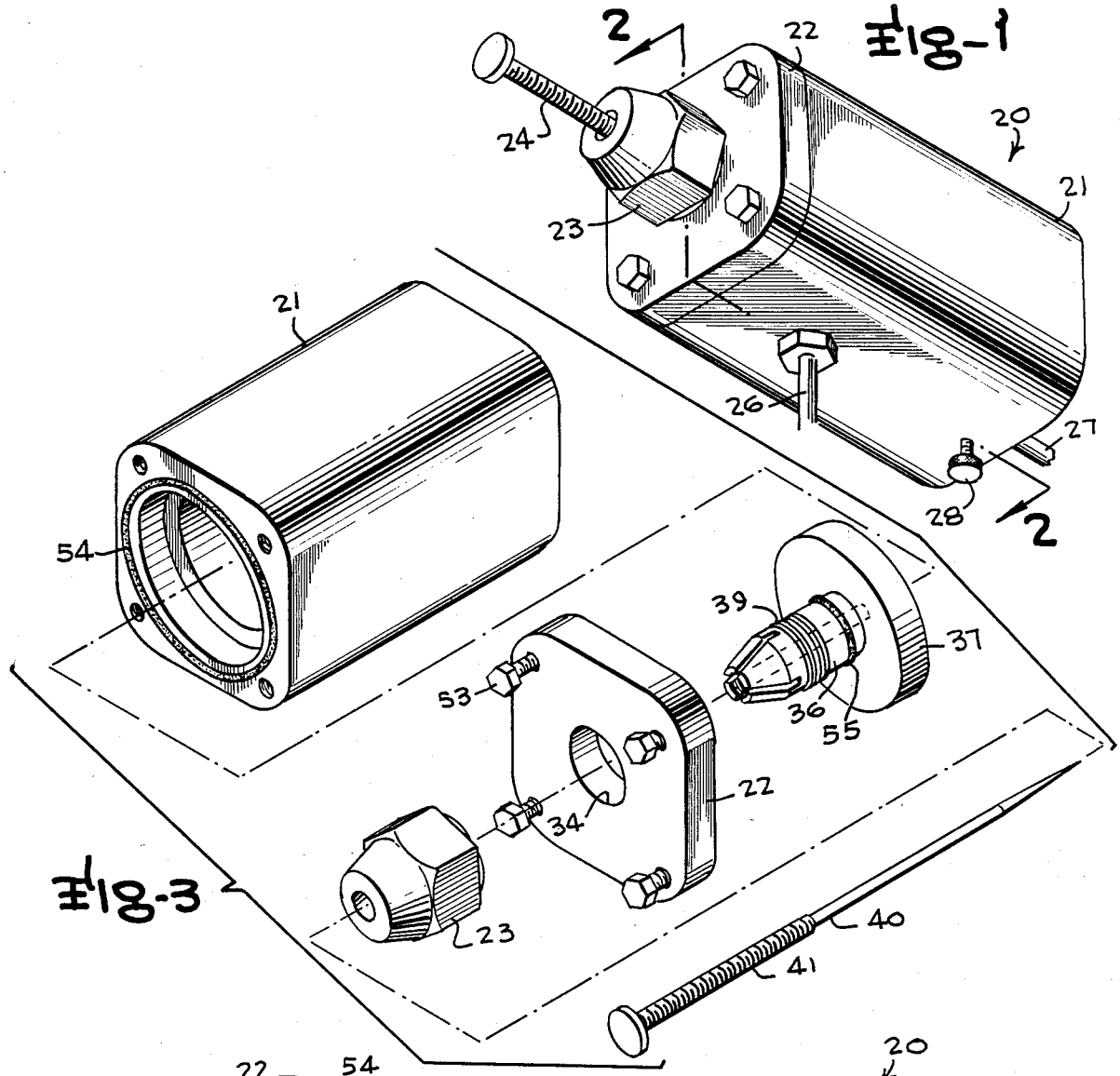
Fig-1
Fig-3
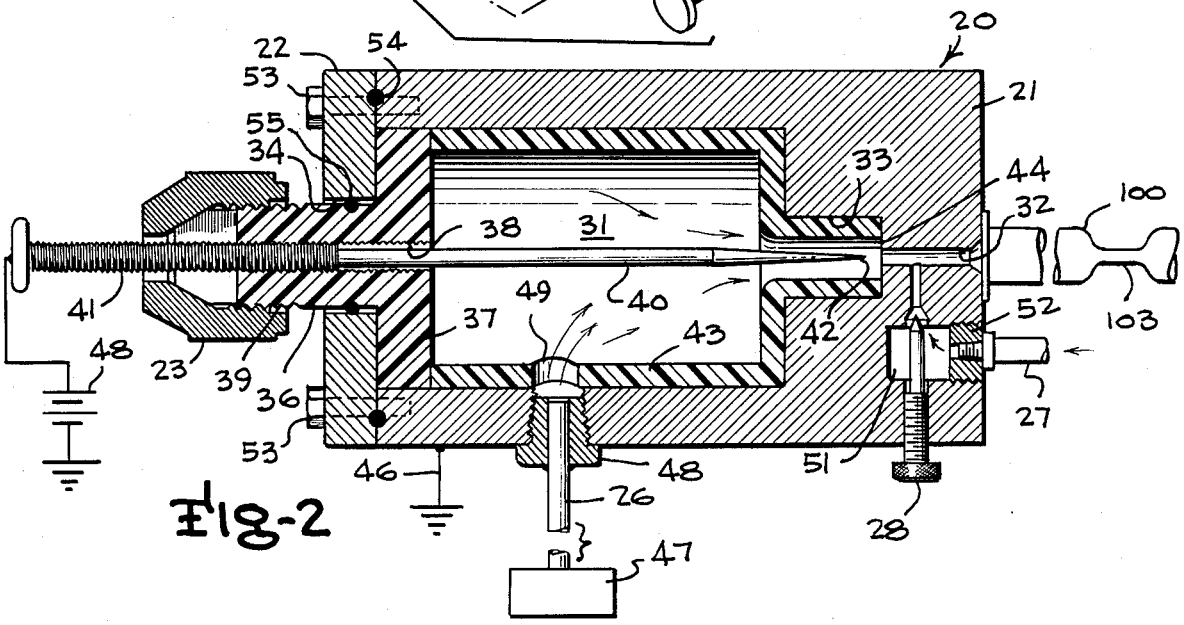
Fig-2

Fig-8
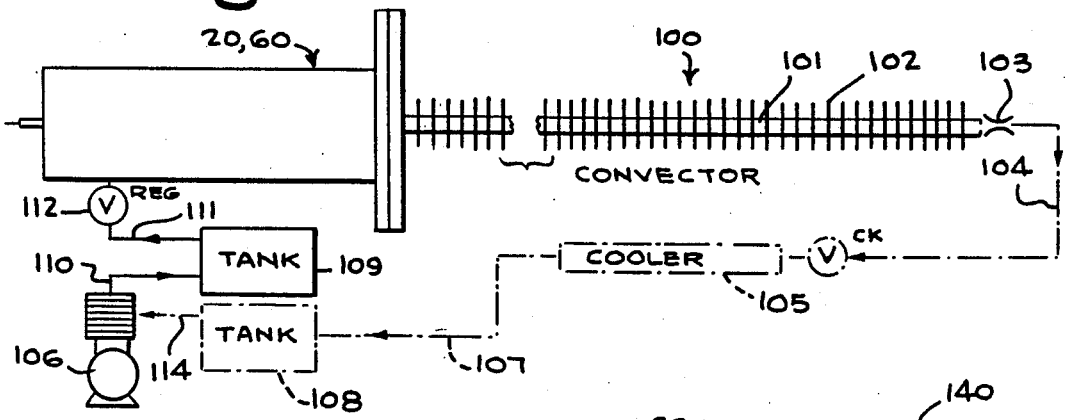
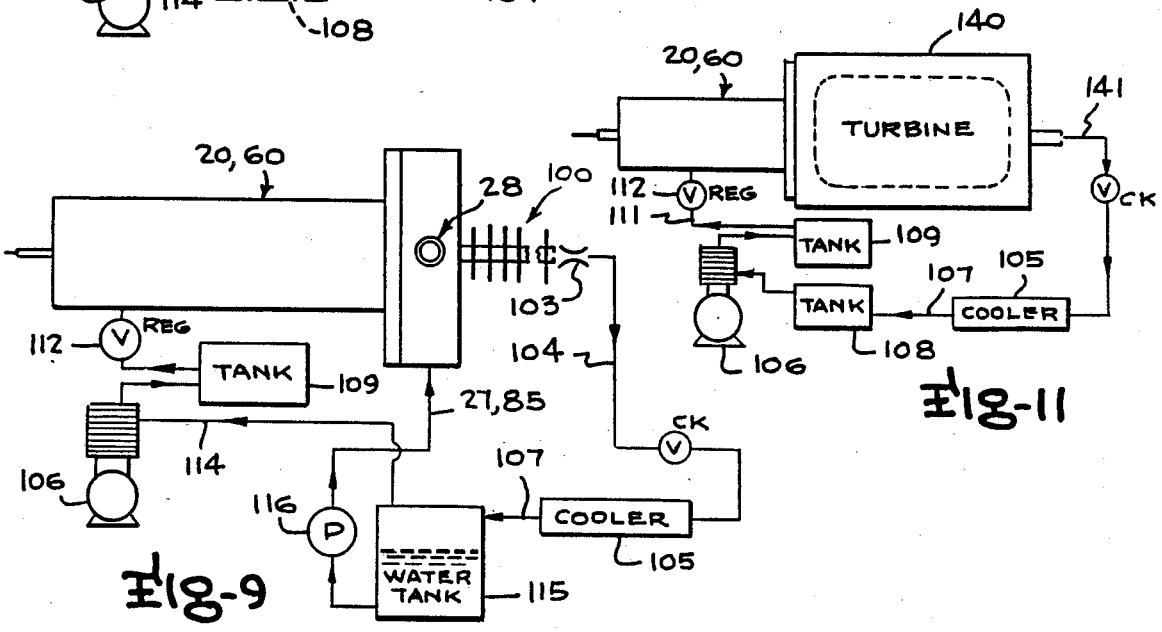
Fig-9
Fig-11
Fig-10
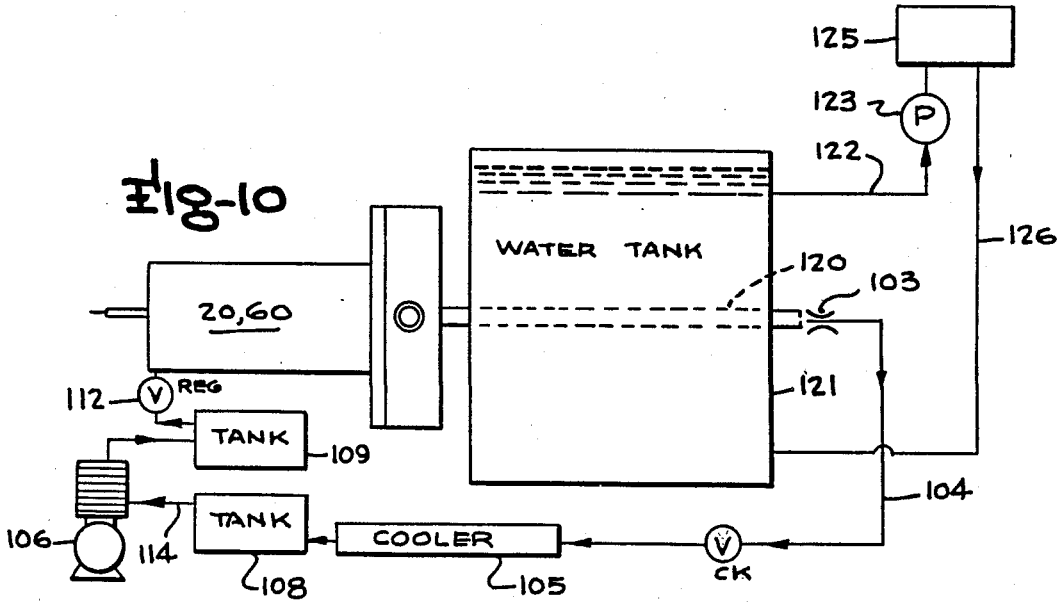

IONIZED GAS ENERGY CELL

This application is a continuation of application Ser. No. 282,401, filed 7/10/81, now abandoned.

TECHNICAL FIELD

This invention is related to the field of ionizing gas, and to the field of generating high temperature gas by ionization.

BACKGROUND ART

Static electricity is the result of a loss or a gain of one or more electrons by atoms making up a body. It has long been known that static electricity may be utilized to cause adherence of two solid articles, and that static electricity may be eliminated if a body which is statically charged is subjected to a stream of ions. Ions are atoms which have gained or lost one or more electrons. Most commonly, air or some other gas is subjected to an electrical potential which excites electrons, causing them to leave the orbit of the atom, thereby making the atom charged; in some instances, the electron which escapes from one atom enters into the orbit of another atom, thereby making that other atom electrically charged. Where one or more electrons leave an atom, it is an unbalanced atom and is known as a positively charged ion, while an atom which receives one or more electrons is designated as an unbalanced, negatively charged atom, or as a negative ion. The production of ionized air, for example, is typically accomplished by providing a high voltage on a sharp point, which is in close proximity to a grounded conductive element. The electrical energy is concentrated by the sharp point, and there is a breakdown in the air molecules and atoms, resulting in the disturbance of the normal balance of electrons, as the electrical energy flows from the point to ground. Ionizers, that is, producers of ionized air, or other gas, have been used for such purposes as the elimination of static electricity, by the generation from alternating current of positive and negative ions which effect static neutralization. Where direct current has been utilized, ionization occurs, but is of one polarity or the other, and the most common applications are in connection with electrostatic pinning or adherence, and xerographic reproduction.

DISCLOSURE OF INVENTION

The present invention is directed to method and apparatus for utilizing ionization for generation of energy. A gas, such as air, is within a chamber or container at superatmospheric pressure, there being a restricted outlet orifice, and, preferably, an inlet for gas (air). Air within the chamber or container is ionized, and ionization is accomplished by disposing the terminus of an electrode adjacent the restricted orifice of the chamber or container, and by applying a direct current source to the electrode. A conductive element, connected to ground or some other source of low potential, is placed in operative juxtaposition with the terminus of the electrode, and is, preferably, at or adjacent the restricted orifice of the container or chamber. The container is preferably made of metal in order to withstand the superatmospheric pressure of the gas within it, and the electrode is made of metal, also, in order to conduct electricity. The electrode is electrically insulated from the container, where both are conductive, either by lining the container with an insulating material, or by encasing the electrode in insulating material. Where the container is provided with an insulating lining or layer, a portion of the container, preferably adjacent the outlet orifice, may be left free of insulating material, and the container connected to ground, to thereby provide a ground reference, the exposed portion of the container being in juxtaposition with the terminus of the electrode. The electrode may be in the form of a long tapering point or cone, and the container may be provided with a conical passage or chamber in which the conical electrode is placed and the passage itself may be of diminishing crosssection towards the orifice; the point of the electrode may be concentric with and closely adjacent the orifice. The apparatus may have a passage for the introduction into the issuing gas stream of an additional material, such a liquid, preferably water or fuel. Ionization occurs adjacent the sharp terminus of the electrode, and a chamber with a restricted outlet receives the ionized gas. Where fuel is injected, it is sprayed into droplets, and the droplets become ionized to the same polarity, and thereby disperse so that great fuel efficiency is achieved upon subsequent combustion of the air-fuel mixture.

The method herein disclosed includes the provision of a body of gas, such as air, under superatmospheric pressure, and the ionization of at least a part of the body of gas to the same polarity. The ionized gas is permitted to escape through a restricted orifice, and issues or discharges at elevated temperature and elevated velocity into a chamber with a restricted outlet. An additional substance, such as a fuel or water, may be added to the issuing or discharging ionized gas stream, to thereby increase the temperature, generate steam, etc. Where fuel is added, it is subsequently burned as a part of a combustible mixture.

The issuing ionized stream, of elevated temperature, may be utilized in various manners, including passing it to a convector having a restricted outlet, where heat is given up to the surrounding atmosphere. Preferably, a closed circuit is provided, the cooled gas from the convector being passed through a cooler, and thence to a tank which is connected with the inlet of a compressor, where the gas is compressed and delivered to the chamber. Where, in such a system, water is introduced into the discharging stream of ionized gas, a water tank may be provided into which the cooler may discharge, and the water tank may be connected to the chamber through a conduit system including a pump. Alternatively, the discharging ionized gas at elevated temperature may be passed through a conduit located in a tank for liquid, such as water, thereby heating the liquid. The heated liquid may be circulated through convectors or similar heat consuming apparatus, and is preferably returned to the tank. Further, the discharging ionized gas stream may have water introduced into it, thereby generating steam, the steam impinging upon a heat conductive wall, on one side thereof, on the other side there being a body of heat receiving material, such as water. The water condensing from the steam may be collected, and returned, to be again utilized in the issuing air stream. Also, the high temperature, high velocity ionized gas may be utilized to drive a turbine, the discharge of which may be connected to a cooler, and recirculated to a compressor for the air to be introduced into the chamber. Further, where fuel is introduced into the issuing ionized stream, the resulting combustible mixture is burned or exploded, in or for use in an engine or turbine.

BRIEF DESCRIPTION OF THE DRAWINGS

FIG. 1 is a perspective view of an ionized gas energy cell in accordance with the present invention.

FIG. 2 is a cross-sectional view taken on the line 2—2 of FIG. 1.

FIG. 3 is an exploded, perspective view of the apparatus of FIG. 1.

FIG. 8 is a schematic view illustrating an ionized gas energy cell in combination with a convector.

FIG. 9 is a view of similar to FIG. 8, with additional apparatus for introducing water.

FIG. 10 is a schematic view of an energy cell in combination with a water tank.

FIG. 11 is a schematic view of an energy cell in combination with a turbine.

BEST MODES OF CARRYING OUT THE INVENTION

Figure 4:
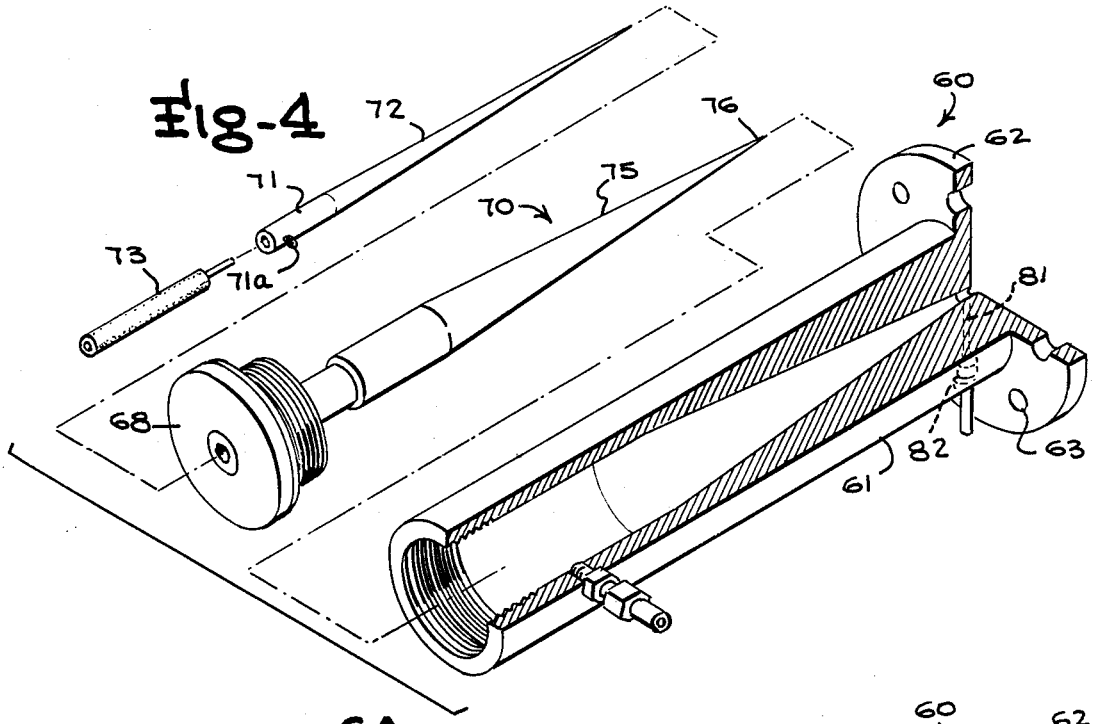
FIG. 4 is an exploded view, with parts in section, of an alternate embodiment.

Referring now to the drawings, wherein like or corresponding reference numerals are used for like or corresponding parts throughout the several views, there is shown in FIG. 1 a perspective view of an ionized gas energy cell 20 in accordance with the present invention, cell 20 comprising a container 21 having an end closure plate 22 at one end thereof. End closure plate 22 has a clamping nut 23 thereon, and an adjusting screw 24 extending through the nut 23. An inlet conduit 26 is provided, as well as a conduit 27, and an adjusting valve 28.

Referring to FIG. 2, the energy cell 20 may be seen to comprise the body 21, which is made of metal, so as to be able to withstand the superatmospheric pressure of the gas contained within it. The body 21, as may be seen in FIG. 1, is of approximately square shape in cross-section, and is elongated, having a generally centrally located chamber 31 within it, connected to an outlet orifice 32 through a reduced passage 33. Opposite the restricted orifice 32, the chamber 31 has an open end which is closed by the end closure plate 22. End plate 22 is provided with an opening 34 (see also FIG. 3) and a boss 36 extends through the opening 34, boss 36 being a part of an inner wall 37, and being provided with a threaded passage 38 therethrough, as well as external threads 39 thereon. The nut 23 has internal threads in engagement with the threads 39 of boss 36, and electrode 40 has a rear threaded portion 41 which is threaded into the threaded passage 38, and is electrically connected to a sources of direct current. The electrode 40 is axially mounted within the chamber 31 by the boss 36 and the wall 37, and has a sharp point or terminus 42 in passage 33 in alignment with the restricted orifice 32. Electrode 40 is of a conductive material, such as steel. Beyond the restricted orifice 32, there is a chamber, as of a convector 100, having a restricted orifice 103.

Electrode 40 is insulated from the metal body 21 by the nonconductive wall 37 and by a liner 43 which is of a size and shape, as shown, to conform to the interior surface of the body 21 which defines the chamber 31, and which defines the passage 33. The thickness of the small diameter portion of the liner 43, which is within the passage 33, is such as to leave exposed an annular corner 44 at the entrance of the restricted orifice 32, and by virtue of the ground connection 46 of the body 21, the corner 44 will serve as a ground reference.

Conduit 26 extends from a source 47 of gas, preferably air under pressure, a coupling 48 connecting it to the body 21; a hole 49 in liner 43 permits the gas to flow into the chamber 31. At the forward end of the energy cell 20, there is provided a passage 51 having a coupling 52 therein, so that fluid supplied by conduit 27 may flow to the orifice 32; passage 51 is under the control of valve 28.

The end plate 22 is secured to the rear face of the body 21 by screws 53 (See. FIG. 3), and a suitable gasket 54 may be used to insure against leakage of gas from the chamber 31 through the rear thereof; a gasket 55 may also be provided around the boss 36, for the same purpose.

In operation, compressed gas, such as air, is introduced into the chamber 31 in the body 21 through conduit 26. The electrode 40 is connected to direct current sources, and, by loosening the nut 23, may be adjusted to the desired axial position, after which the nut 23 may be tightened, to lock it in position. That position is with the terminus 42 of electrode 40 in spaced relationship to the annular corner 44, providing the ground reference for the voltage applied to the electrode 40, and more particularly to the terminus or point 42 thereof. Preferably, the voltage applied is in the range of 10–100 KV relative to the lower potential of the reference voltage, which as herein illustrated is ground potential. The pressure within the chamber may be approximately 8 or 9 atmospheres. The compressed gas escapes at high velocity and temperature through the restricted orifice 32. That compressed gas is ionized by the voltage applied to the terminus or sharp point 42 of electrode 40 by source S, with discharge of the potential to ground by way of the annular sharp corner 44. Due to the small size of passage 33 compared to chamber 31, and to the location of point 42 relative to grounded corner 44, ionization is only from the point 42 forwardly, and no significant ionization occurs in chamber 31. The point 42 may erode, and therefore the electrode 40 may be adjusted axially to compensate for such erosion, as well as being adjusted for optimum distance relative to the annular corner 44, that is, the ground reference. Water or a fuel may be supplied through the conduit 27 in passage 51, and if water is supplied, it will be heated and changed into steam, and if fuel is supplied, the heat of the discharging gaseous material will vaporize it and cause it to burn, assuming that the gas is air or another gaseous material which will support combustion.

The principle of operation of the energy cell 20 is believed to be as followed. The superatmospheric pressure within the chamber 31 forces the molecules and/or atoms making up the air or other gas within chamber 31 into a closer proximity to each other, as they move in normal fashion. In the field between the electrode 40, in particular the point 42 thereof, and ground reference, provided by the annular corner 44, electrons are removed from the atoms and/or molecules of the gas, leaving them with the same unbalanced electric charge, that is, they have the same polarity. As a result, they are ionized and since they have like charges, tend to repel. The atoms or molecules, being highly excited, and being mutually repelling, will discharge to the region of lower pressure, which is located beyond the energy cell 20, discharge occurring through the restricted orifice 32. The issuing gases or gaseous material is characterized by elevated temperature and velocity. The gases may convert water into steam, or cause combustion of a liquid fuel introduced thereinto.

Figure 5:
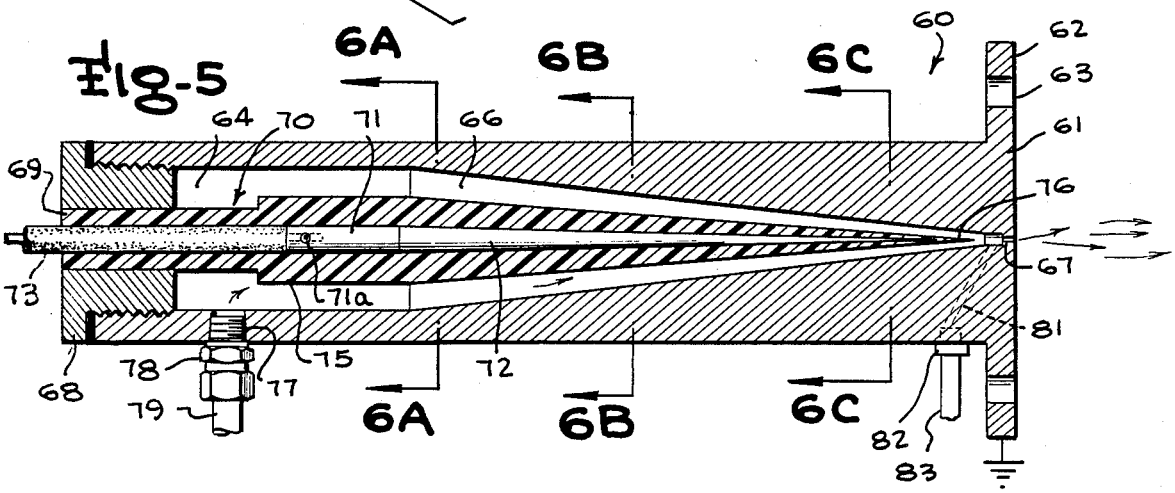
FIG. 5 is a longitudinal cross-sectional view of the apparatus of FIG. 4.

Referring to FIGS. 4 and 5, there is shown an alternate embodiment of the present invention apparatus and method, the ionized gas energy cell 60 comprising a body 61 of generally cylinderical configuration, and having integral mounting flanges 62 with bolt holes 63 therein. The body 61 has a chamber therein which has a cylinderically shaped rear portion 64 and a conical front portion 66, chamber portion 66 tapering forwardly to a restricted outlet orifice 67. The rear of the chamber 64 is closed by a threaded plug 68 having an axial passage 69 therethrough. A conductive electrode 70 is provided and includes a rear portion 71 of generally cylindrical shape, and a long conical front portion 72. Electrode 70 is preferably concentrically mounted within the chamber 64, 66, and its axis coincides with the axis of the chamber in the body 61. Electrode 70 has the wire of an insulated conductor 73 secured therein by a screw 71a. An insulated sleeve 75 surrounds the conductive portions 71, 72, and also a portion of the insulated conductor 73, being received within the axial passage 69 of plug 68. The sleeve 75 engages the conductive portion 71, 72 of the electrode 70, is generally cylindrical at its rear end where it engages the axial passage 69, is of larger cylindrical diameter within the chamber portion 64, and is conical where it lies within the chamber portion 66.

Figure 6A:
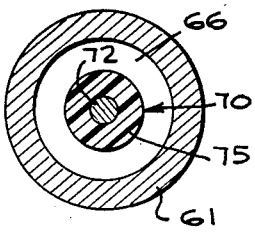
FIGS. 6A, 6B, and 6C, are cross-sectional views taken on lines 6A—6A, 6B—6B, and 6C—6C of FIG. 5.
Figure 6B:
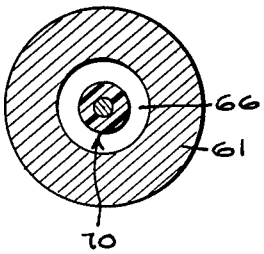
Figure 6C:
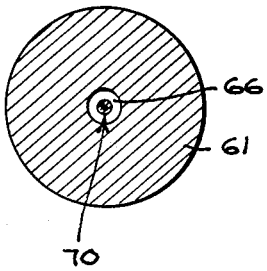

The conical angles of the conical portion of the sleeve 75 and of the conical portion 66 of the chamber within body 61 are chosen so that there is a diminishing passage towards the restricted orifice 67. Referring to FIG. 6A, there is shown the body 61, with electrode 70 therein, including sleeve 75 and conductive portion 72, and there is also shown the size of the portion of chamber portion 66 not occupied by electrode 70. FIG. 6B shows the remaining portion of chamber portion 66 to be much smaller, and FIG. 6C shows the further reduction in the size of the chamber portion 66 near the restricted orifice 67. The electrode 70 has a sharp point or terminus 76, which is co-axial with the restricted orifice 67 and is directed towards it.

At the rear of the body 61, there is a lateral opening 77, in which there is a coupling 78 for a conduit 79, to admit compressed air into the chamber portion 64. Near the front of the body 61, there may be provided a passage 81 leading to the forward portion of the chamber portion 66, adjacent the restricted orifice 67. The passage 81 has a coupling member 82 therein, for connection of a conduit 83. Conduit 83 may be connected to a suitable source of a liquid, such as a liquid fuel or water.

Figure 7:
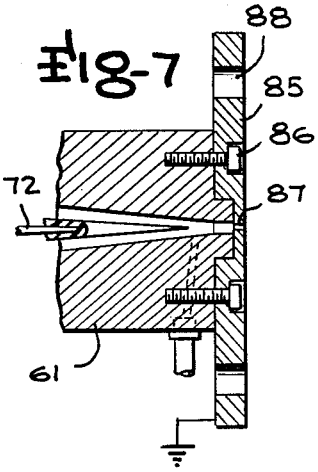
FIG. 7 is a cross-sectional view of a portion of an alternate embodiment.

In FIG. 7, there is shown an alternate embodiment, in which the body 61 is provided with a separate front plate 85 which contains a restrictive orifice 87, plate 85 being secured to body 61 as by screws 86, and having mouting holes 88 therein to enable the connection of the energy cell to some additional structure. Otherwise, the embodiment shown in FIG. 7 is the same as the embodiment of FIGS. 4 and 5. In both embodiment, the body 61 is of metal, as is the plate 65 in FIG. 7, and in both, the body 61 is suitably grounded.

In operation, ionization takes place in the region forwardly of the tip 76, and is therefore relatively localized. The high voltage applied to the conductive portion of electrode 70 results in the gain or loss of electrons of the atoms and/or molecules at the surface of the conductive portion 71, 72. This results in polarization of the insulating sleeve 75, so that at its exterior surface, there are also ions, that is, molecules or atoms having an excess or a deficiency of electrons. Due to this state of polarization of the exterior surface of the insulating sleeve 75, enhanced or amplified adjacent the tip 76, there is an electrostatic field adjacent the tip 76, between it and the interior surface of the body 61 which defines the forward portion of chamber 66. Thus, electrons will flow in this space, causing ionization of the gas (air) atoms and/or molecules in that region. Because of the repulsion of these polarized air or other gas atoms and/or molecules due to their being of the same polarity, gaseous material will attempt to move to the area of low pressure, that is, through the restricted orifice 67. Thus, the discharging stream of gaseous material will be at high velocity and elevated temperature. The diminishing size of the passage, towards the restricted orifice 67, assists in the concentration of atoms and/or molecules within a given volume, and enhances the operation of the energy cell 60. Preferably, the voltage range and pressure range hereinabove mentioned in connection with FIGS. 1–3 are utilized in the embodiments of FIGS. 4–7.

Further, the apparatus of FIGS. 4–6 will have long life, does not require adjustment of the positon of the electrode, since there will be little if any erosion of the electrode, and particularly of the point 76 thereof. In addition, the embodiment of FIG. 7 has the additional advantage of permitting replacement of a portion of the apparatus which is subject to wear, that is, the portion containing the restrictive orifice.

The method and apparatus has hereinabove disclosed have utility for various purposes, including particularly the generation of heat, and for the generation of high velocity gas stream, and a number of cooperating utilizing systems are set forth herein below.

In FIG. 8, a gas ionizing energy cell 20, 60, is provided, and having connected to it, so as to receive the gaseous material discharged from it, a convector 100 which comprises a conduit 101 of conductive material, having a plurality of fins 102 thereon. Thus, the convector 100 will transfer heat to the material surrounding it, such as air, some other gas, or liquid. At its end remote from the energy cell 20, 60, the convector 100 is provided with a restrictive orifice 103. Conduit 101 is larger in diameter than the restrictive orifice of the energy cell 20, 60. The convector 100 discharges into a conduit 104, from the restrictive orifice 103, the gases flowing to a cooler 105, and thence to a compressor 106, by way of conduit 107. A holding tank 108 for the cooled gas may be provided, and appropriate valves may be incorporated into the tank 108 in known fashion. The discharge from compressor 106 may be passed through conduits 110, 111, the latter having a regulating valve 112 therein.

In FIG. 9 apparatus is shown which is generally similar to the apparatus of FIG. 8, there being provided, however, a water tank 115 having a space for gas in the upper portion thereof. A pump 116 causes water to flow through conduit 27, 85 into the energy cell 20, 60 under control of a suitable valve, such as valve 28. The gas space within tank 115 is connected by conduit 114 to a compressor 106, and there is provided a further tank 109 and regulating valve 112. Thus, water introduced through conduit 27, 85 will be converted into steam, which will enter into the convector 100. The cooler 105 will reduce the temperature of the fluid discharging from the convector 100, and the steam will have been condensed, and will be delivered to the water tank 115, and may be recycled.

In FIG. 10, the gaseous material discharged from the ionizing gas energy cell 20, 60 is delivered to a conduit 120, which is heat conductive, and which is located in a water tank 121. At the end of the conduit 120 remote from the energy cell 20, 60, there is provided a flow restrictor 103, connected by conduit 104 to cooler 105. Cooler 105 is connected to tank 108, which is connected by conduit 114 to compressor 106. Compressor 106 deliveres its output to tank 109, the output of which passes through check valve 112 to energy cell 20, 60. A conduit 122 extends to a pump 123, and to the water tank 121, to withdraw heated water therefrom, the water then being delivered to a heat transfer device 125, which may be one or more convectors, etc. A return conduit provides for the return of cooled water from the heat transfer apparatus 125 to the tank 121.

In FIG. 11 there is shown an embodiment wherein the discharge from the air ionizing energy cell 20, 60 is delivered to a turbine 130, the discharging gaseous material serving to drive the turbine in order to produce power. The discharge from turbine 130 passes through a conduit 131 to a cooler 105, and the outlet of the cooler is delivered through conduit 107 to tank 108, which is connected to a compressor 106. The outlet of the compressor delivers compressed air or other gas to tank 109 which is connected by conduit 111 and pressure regulating valve 112 to the energy cell 20, 60.

Figure 12:
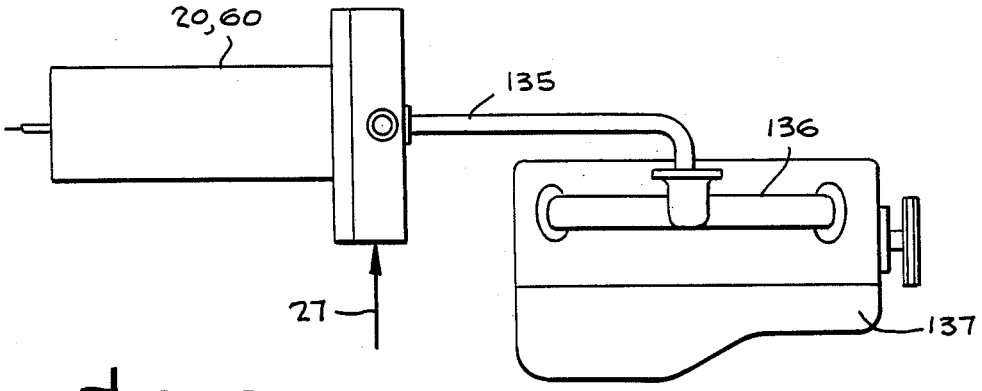
FIG. 12 is a schematic view illustrating an ionized gas energy cell in combination with an internal combustion engine.

In FIG. 12 there is shown the ionizing air energy cell 20, 60, with inlet for a fuel. The fuel issues form the restricted orifice, along with the ionized gases, which are ionized to the same polarity. The fuel in the form of a spray, is divided into even finer droplets, and because of the same-polarity characteristic of the fuel droplets, they repel each other and are dispersed in a very fine dispersion within the gas. Since the gas is air or some other oxygen-containing gaseous material, there is thereby provided a combustible mixture. The combustible mixture is delivered through the conduit 135 to the intake manifold 136 of an internal combustion engine 137, wherein it may be exploded or burned in known manner.

Figure 13:
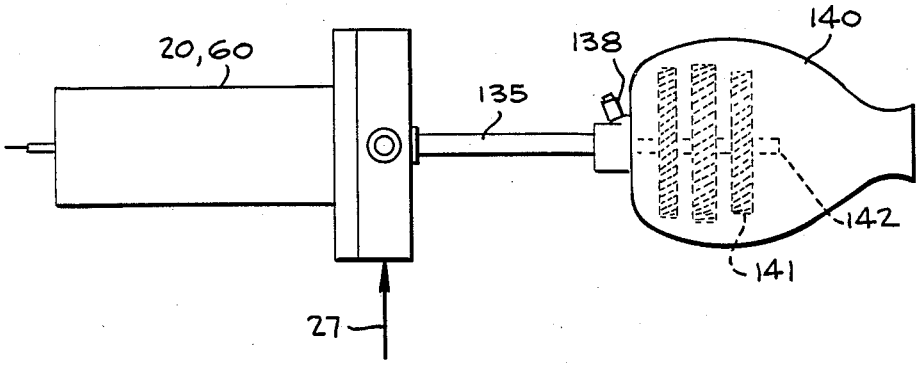
FIG. 13 is a schematic view illustrating an ionized gas energy cell in combination with a turbine.

In FIG. 13, the ionized air energy cell 20, 60 delivers a combustible mixture into the conduit 135, in the manner described above in connection with FIG. 12. An igniter 138 is provided, at an appropriate place in the apparatus, and therefore fuel is delivered to a turbine 140. It will be understood that the turbine has rotors 141 and a shaft 142, as is well known. The ignition of the combustible mixture may occur within the turbine 140, rather than exteriorily thereof as indicated in FIG. 13.

The herein disclosed apparatus and methods are capable of generating, through ionization of gas, such as air, a stream of high velocity, high temperature gaseous material. Efficient utilization of energy in-put is achieved by the disturbance of atoms or molecules, by virtue of the removal or addition of electrons under superatmospheric pressure and in a confined region. There may be added to the issuing or discharging stream of gaseous material, made up of ions and electrons, an additional material, such as water, which is converted into steam, or fuel, which may be burned, combustion supported by the discharging stream of gaseous material.

Various equipment may be utilized in conjunction with the herein disclosed air ionizing energy cells, such as various categories of heat transfer apparatus, and apparatus for converting energy in a discharging gas stream into mechanical movement.

It will be obvious to those skilled in the art that various changes may be made without departing from the spirit of the invention, and therefore the invention is not limited to what is shown in the drawings and described in the specification but only as indicated in the appended claims.

I claim:

1. Apparatus for ionizing gas comprising:

a gas ionizing energy cell for generating a flow of high temperature ionized gaseous material comprising container means for receiving a compressed gas, said container means having restrictive orifice means therein for permitting the discharge of the compressed gas therefrom and being formed of a solid conductive material, electrode means in said container means having a discharge point in spaced adjacent relationship to said orifice means for ionizing the gas being discharged from said container means forwardly of said discharge point, and connecting means for connecting said electrode to a high potential direct current source;

supply tank means for holding a liquid therein, said supply tank means including a gas space therein;

liquid conduit means providing fluid communication between said supply tank means and said energy cell for introducing liquid from said supply tank means into the ionized gas discharged from said container means to form a gaseous material;

convector means in fluid communication with said orifice means for receiving the ionized gaseous material discharged by said energy cell and extracting energy therefrom;

gaseous conduit means providing fluid communication between said convector means and said supply tank means for delivering the ionized gaseous material from said convector means to said supply tank means;

gas conduit means providing fluid communication between said container means and said gas space in said supply tank means for supplying gas from said gas space to said container means; and compressor means interposed in said gas conduit means between said supply tank means and said container means for pressurizing the gas from said gas space.

* * * * *